US007025141B1

(12) United States Patent
Grebennikov et al.

(10) Patent No.: US 7,025,141 B1
(45) Date of Patent: Apr. 11, 2006

(54) METHOD OF INCREASING THE WELL RATE OF EXPLOITATION AND RECHARGE WELLS

(75) Inventors: Valentin Timofeyevich Grebennikov, Moscow (RU); Anatoly Ivanov, St. Petersburg (RU); Mikhail Popov, Bolshevo (RU)

(73) Assignee: Nord Service Inc., Little Rock, AR (US)

( * ) Notice: Subject to any disclaimer, the term of this patent is extended or adjusted under 35 U.S.C. 154(b) by 0 days.

(21) Appl. No.: 10/957,872

(22) Filed: Oct. 4, 2004

(51) Int. Cl.
*E21B 43/00* (2006.01)

(52) U.S. Cl. ..... 166/298; 166/308.1; 166/55

(58) Field of Classification Search ..... 166/55, 166/55.1, 55.2, 55.3, 305.1, 298
See application file for complete search history.

(56) References Cited

U.S. PATENT DOCUMENTS 4,491,022 A * 1/1985 de la Cruz ..... 73/783
5,445,220 A * 8/1995 Gurevich et al. ..... 166/55
6,651,741 B1 * 11/2003 Bassin et al. ..... 166/268

* cited by examiner

*Primary Examiner*—William Neuder
(74) *Attorney, Agent, or Firm*—Houston Eliseeva LLP

(57) ABSTRACT

The invention includes a method of increasing of the well rate of exploitation and recharge wells, comprising a means of decreasing the stress state in the well area by constructing of slot-like discharge key seats, wherein the slot-like key seats have a screw-like shape, wherein preliminary internal rock friction angles ρ are determined for a rock composing a productive strata, and a pitch of the slot key seat screw is selected such that the tangent of the angle of deviation of the slot surface from the ϕ vertical will be between $tg(45-\rho/2) \geqq tg(\phi) \geqq 1/\sqrt{3}$, where 92 —is the internal rock friction angle where the key slot is being made.

4 Claims, 1 Drawing Sheet

METHOD OF INCREASING THE WELL RATE OF EXPLOITATION AND RECHARGE WELLS

FIELD OF THE INVENTION

The present invention relates to the oil and gas extracting and hydrogeology industry and is designed to increase the well rate of exploitation and/or recharge wells by means of decreasing the stress state of the well area at the productive strata.

BACKGROUND OF THE INVENTION

There are known methods of increasing well rates that are applied in cases if the rate is much lower than the estimated rate. Vertical and horizontal relief slots are cut into borehole walls, the effective drainage area is fractured, and the bottom-hole area is processed by strata treating reagents like liquids and powders, for example.

The most effective of above-mentioned methods is the discharge of the well area by the cutting of slots and that means the formation of orientable slot-like cavities. Such a method can increase the well rate by several times and maintain it for a long time period. Methods of fracturing and strata treatment provide less effect, which usually does not last long and makes necessary periodical repeated well treatment. Besides that, when the strata is treated by chemical reagents considerable difficulties arise when the strata treating solution is being delivered to the strata—huge amounts are lost when the liquid is injected into the borehole. This process changes the compound and can badly impact injecting devices, constructive elements and the borehole.

Usually well rate increasing methods are combined. For each case, the sequence of methods applied are selected based on the well economic and technical optimal conditions for each of them are selected.

There are also numerous detailed implementations of mentioned methods. Among one of known methods is the construction of horizontal slot key seats located in the well zone above and below of the productive strata (and in the strata itself, if it is thick enough). Such slots are at the expense of formation of dome-shaped mine in the well area "transfer" the abutment zone inside the strata. In fact, the creation of such key seats increases the well radius pro rata the depth of the slot formation at the places of formation of horizontal slots.

The construction of horizontal slots in the well area within the productive strata interval helps 'clean' the wall packing zone in the slots interval. In the bearing pressure zone tension meanings are close to rock solidity indexes and the creation of such bearing pressure zones considerably decreases rock characteristics. When a fracture is formed in the horizontal slot well it requires lower indexes of surface pressure and its extension within the strata will exceed the horizontal slot diameter.

The creation of two opposite vertical discharging slot key seats in the well zone, the depth of which will not be less than two well diameters for the all productive strata capacity, orientated straight across main tensions in the strata is more effective. At the edges of such key seat stress concentrators cause the re-distribution of stresses in the well area. Such re-distribution forms a rather powerful (more than the depth of the wall packing zone) high penetration zone (the discharges zone, the length of such zone from the forming capital string often exceeds 20–30 well diameters, and its width is equal to the sum of slot depths at each side plus the well diameter). When the border of the discharge zone initiates a fracture crack during fracturing, such a crack is always formed outside the wall packing zone. This method is hindered by the necessity to orientate discharge slots and to determine the direction of the main compounding stresses in the massive.

There is also a method providing for the creation of two opposite vertical discharging slot key seats in the well zone, the depth of which will not be less than two well diameters for all productive strata capacity, orientated straight across main tensions in the strata. For the purpose of additional slot discharge of the effective drainage area a second pair of vertical slots is formed in the well. They are placed symmetrically to the well, at the same time the second pair of slots is orientated across the first one and is not less than 0.5 depth of main slots.

The optimization of the last method consists in the selection of the width of the key seat opening and of its depth, and the depth of each key seat for main slot key seats (L)—is not less than 2 well diameters (d) from the forming one and the t opening should not be less than $$t=1,6\gamma H/Ea;\ a=2L+d;$$

where γH—is the ground pressure at the depth of H, E—the coefficient of rock elasticity, a—the summary size of the well and two slots: a=2L+d.

The optimization of sizes of the second (additional) pair of slots consists in the selection of their depth of no less than 0.5 the depth of the main slots with the same opening. The method provides for the formation of two pairs of slot key seats located symmetrically from the well. Pairs of key seats are located opposite each other.

Though the prior art methods have merit—high efficiency, cost effectiveness, long lasting results, they have several principal shortcomings:

- Difficulty and sometimes impossibility in determining the force vectors of main stresses, across which the slots should be formed;
- Difficulty and sometimes impossibility to orient the created slot in the well zone to a given direction;
- High labor intensity in creation of discharge cavities without optimal guarantees and guarantees to increase the well rate.

Mentioned shortcomings do not allow increasing well rates up to their potential possible index and/or up to their estimated amount.

SUMMARY OF THE INVENTION

The present invention increases the efficiency of slot discharge of a well zone, with lessdifficulty and labor intensity.

The present invention relates to the oil and gas extracting and hydrogeologic industry and is to be used in exploitation and/or recharge wells. The task is to increase the well rate.

The new fact is that the this method of the increasing the rate is accomplished by providing for the construction, in low productive intervals of the productive strata, of slot key seats, wherein the slot key seats have a screw shape, as can be seen in FIG. 1, which shows a well 1, in rock 2, wherein are cut screw shaped slot key seats 3, for one embodiment of the invention.

In order to increase efficiency, internal friction coefficients ($K_{BT}$) are determined beforehand for rocks forming the productive strata, and a screw pitch is selected in order that the tangent of the slot surface pitch angle to the horizon would be equal to tg(45−ρ/2), where ρ—is the rock internal friction angle, where the key seat is being made. It allows for elimination of the operation of orientation of slot key seats relative to force vectors of main massive stresses and to get along without a pair of additional slots, perpendicular to main ones, as it guarantees that within one loop of the screw-shape key seat the slot key seat at least twice will be perpendicular to the force vectors of main massive stresses. The screw-shape slot discharge key seat can be performed by separate vertical jogs in stages from the downside up, before the first pair of vertical jogs is constructed parallel to the well axis. Arbitrarily oriented relative to the direction of the main massive stress, the height from the footing of the productive strata is 1–2 well diameters, located symmetrically in opposite directions from the well axis. Then a second pair of vertical jogs of the same length are constructed, and at the same time the horizontal symmetry axis of the second jog is turned right from the horizontal symmetry axis of the first jog to the a angle, calculated according to the formula: $\frac{1}{2}<(\sin\alpha=d/L)<\sqrt{2}/2$. The second pair of jogs is located upper from the first pair in order that a straight line connecting the far point of a top of any of the first pair of jogs with a point at the well axis laying in one horizontal surface with the selected top, lays in one horizontal surface with the far point of the basement of the upper laying jog and has an angle of deviation from the ϕ vertical=(45−ρ/2), where ρ—is the internal friction. A third and following pair of jogs is made of the same length and is consequently orientated relative to previous jogs as the orientation of the second pair of jogs relative to the first pair of jogs.

DETAILED DESCRIPTION OF THE INVENTION

Figure 1:
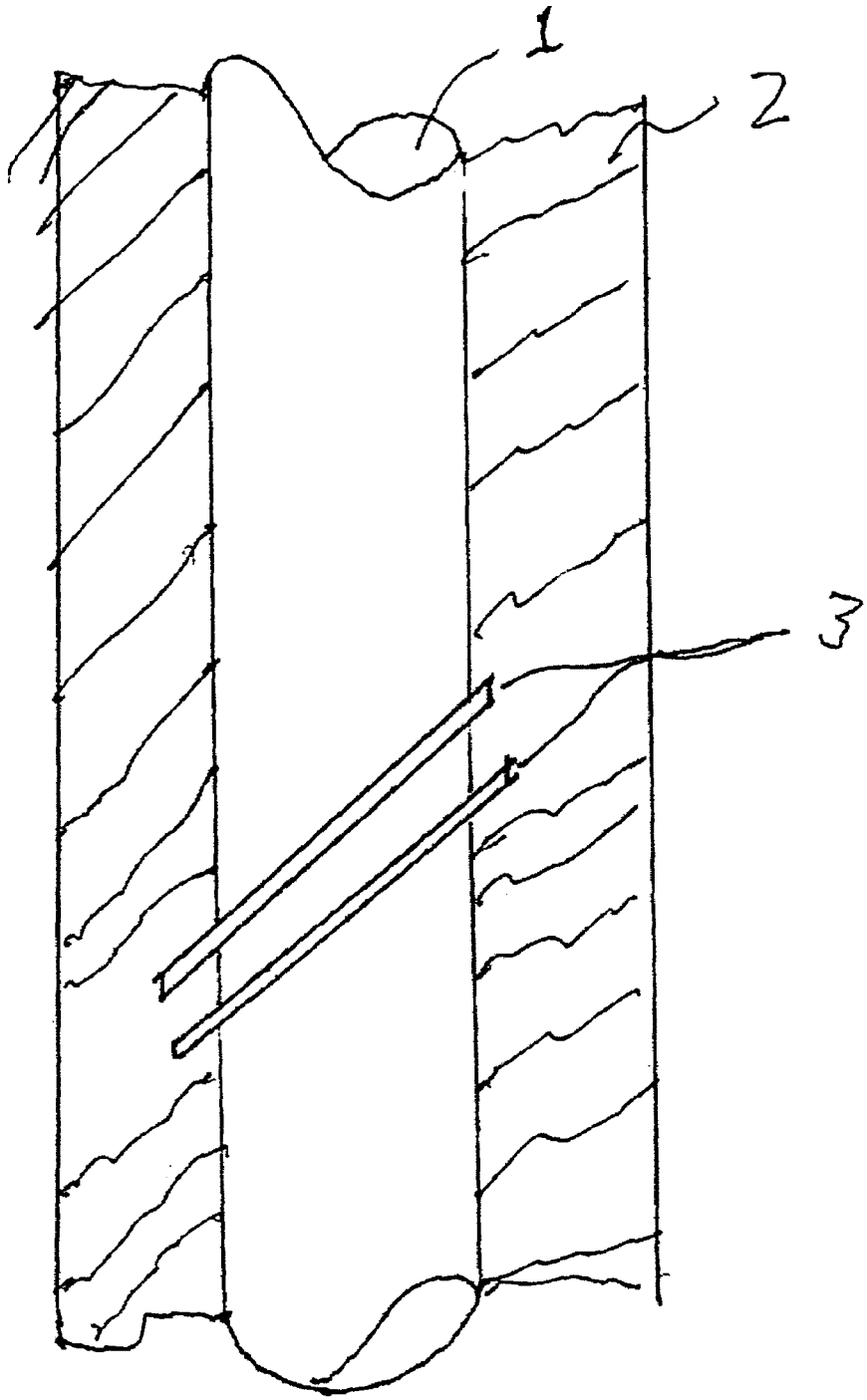
FIG. 1 shows a well in rock, wherein are cut screw-like slot discharge keys, for one embodiment of the invention.

The task is solved in such a way, that the known method of increasing of the well rate of the exploitation or recharge wells, in productive strata providing low productive intervals, by construction of slot key seats considerable changes have been made, namely:

Slot key seats are made in screw-shaped form.

It allows for excluding the operation of orientating slot key seats relative to force vectors of main massive stresses and avoids the construction of pairs of additional slots, perpendicular to main ones, as it guarantees that along one loop of the screw-shaped key seat (slot key seat) it will be at least twice perpendicular to force vectors of the main massive stresses.

For the purpose of the following efficiency increase of the method angles of shearing resistance ρ are previously identified for rocks forming the productive strata, and the screw pitch of slot key seats is given in such a way, that the tangent of the angle ϕ of deviation of the slot surface from the vertical will be between tg(45−ρ/2) and $1/\sqrt{3}$, i.e.:

$$tg(45-\rho/2)\geqq tg(\phi)\geqq 1/\sqrt{3},$$

where ρ—is the angle of the rock internal friction, where such key seat is being built.

In productive stratas, for which the calculated as above mentioned tangent of the angle of deviation of the slot surface from the vertical approximately (with the 15% allowance) is equal to tg(45−ρ/2), i.e.

$$tg(\phi)=tg(45-\rho/2)\pm 0.15,$$

key seats can be built as vertical, arbitrarily oriented, at the same time the slot opening should not be less than ⅓d, where d—is the well diameter.

It is offered to carry out the screw-shaped discharge key seat by separate vertical jogs by stages from the downside up. First, two first vertical jogs are constructed parallel to the well axis, which are arbitrarily oriented relative to the direction of the mainmassive stress—the height from the productive strata lower boundary is 1–2 well diameters, located symmetrically to the opposite directions from the well axis. When the second pair of vertical jogs is being constructed, at the same time the horizontal symmetric axis of the second pair of jogs is turned to the right from the horizontal symmetry axe of the first pair of axes to the a corner, calculated according to the formula: $\frac{1}{2}<(\sin\alpha=d/L)<\sqrt{2}/2$. The second jogs are located upper from the first ones, in such a way that a straight line connecting the far point of a top of the any of the first pair of jogs with a point at the well axis laying in one horizontal surface with the selected top, lays in one horizontal surface with the far point of the basement of the upper laying jog and has the angle ϕ of deviation from the vertical=(45−ρ/2), where ρ—is the internal friction. A third and following pairs of jogs are made of the same length and are consequently orientated relative to previous jogs as the orientation of the second pair of jogs relative to the first pair of jogs;

In the case where the calculated pitch of the screw-shaped key seat exceeds the strata thickness, the screw pitch is selected to be equal to the strata thickness. When drilling wells which, within the productive strata, are horizontal or the piped direct wire routing (horizontal bore hole planning is more than 20 well diameters, but not less the productive strata power) the drilling direction is selected perpendicular to the direction of the force vector of the main massive stress. Besides that, at such horizontal or hollow well plots slot discharge key seats have a vertical orientation. L deep slots are to be achieved from the string column wall for all thickness of the productive strata (up to the roof/footing) or not less than 4 well diameters.

The substance of invention is explained by the below mentioned detailed example of its implementation. First of all, by all known methods, low productive intervals of the productive strata are defined and internal friction angles ρ of all productive strata layers are determined. Also, the strata pressure is calculated at the depth of the γH productive strata layer.

Then, the screw-shaped key seat pitch is calculated. This pitch should be such that the tangent of the slot surface deviation angle (p from the vertical should be located within tg(45−ρ/2) and $1/\sqrt{3}$, i.e.:

$$tg(45-\rho/2)\geqq tg(\phi)\geqq 1/\sqrt{3},$$

where ρ is the rock internal friction angle, where such key seat is being constructed.

In the situation where the estimated pitch of the screw-shape discharge slot exceeds the strata thickness, then the screw pitch will be selected to be the same thickness as the productive strata.

Then, a screw-shaped slot is constructed in the productive strata interval vertical mine workings (for example, by means of the hydrojet or mill).

For example, screw-shaped key seats can be fulfilled in such a way:

key seats are constructed by separate vertical opposite pairs of jogs in stages from upside down the well productive strata, first of all a first pair of opposite vertical jogs are constructed parallel to the well axis— the height from the lower boundary of the productive strata is 1–2 well diameters. When a second and following pairs of key seats (slots) of the same height as the first pair are constructed, all of them have radial and symmetric orientation to opposite directions from the well axis, though each following pair of key seats is located above the previous pair at such a distance on the vertical, that a straight line, connecting the far point of the top of the any of the first (or previous) pair of jogs with a point at the well axis, laying in one horizontal surface with the far point of the footing of the upper jog and having the vertical deviation angle $\phi=(45-\rho/2)$, where $\rho$ is the internal friction angle.

At the same time the horizontal symmetry axis of the second (and/or following) pair of jogs is turned right from the horizontal symmetry axis of the first (and/or previous) pair of jogs to the $\alpha$ angle, calculated according to the formula:

$$\tfrac{1}{2}<(\sin\alpha=d/L)<\sqrt{2}/2;$$

where d—is the well diameter;

L—is the key seat depth (depth of the discharge cavity) from the well wall.

In the situation where the productive strata has a layered structure, then the pitch angle of the mentioned screw-shape key seat is made variable according to the internal friction angle of each layer. For this purpose the pitch angle is compared with previously determined indexes of the internal friction angle. This provides for maximal efficiency of the impact of discharge key seat design on the strata. If the layer is less thick than the well diameter, then the pitch is not changed, because in such cases the instrument error of the spatial orientation of discharge key seats exceeds the index of the necessary pitch angle.

In productive strata layers with internal friction angles $\rho$ indexes, for which the tangent of the slot surface deviation angle calculated according to the mentioned formula for the deviation $\phi$ from the vertical is approximately (with 15% allowance) equal to $tg(45-\rho/2)$, i.e.

$$tg(\phi)=tg(45-\rho/2)\pm0.15,$$

key seats can be constructed as vertical, arbitrarily oriented, and having the same depth as the screw-shaped part of the key seat and an opening (key seat width) of not less than ⅓ d, where d—is the well diameter.

So, our opinion is that the applied invention contains the following new provisions:

Mine workings in the form of screw-shaped slots;

Preliminary measurement of internal friction angles $\rho$ in all productive strata layers;

The screw pitch is selected in such a way, that the tangent of the slot surface deviation pitch angle $\phi$ from the vertical is located between $tg(45-\rho/2)$ and $1/\sqrt{3}$, i.e.:

$$tg(45-\rho/2)\geqq tg(\phi)\geqq 1/\sqrt{3},$$

where $\rho$—is the rock internal friction angle, where such key seat is being constructed.

Carrying out of the screw-shape slot discharge key seat be separate vertical opposite jogs in stages from the downside up;

At the same time, in case the productive strata has a layered structure, the pitch angle of the mentioned screw-shaped key seat will be variable according to the internal friction angle of each layer. For this purpose, the pitch is compared with preliminary defined indexes of the internal friction angle. This provides maximum effectiveness of the impact of the discharge key seat on the strata. If the thickness of a layer is less than the well diameter, then the pitch does not change, as in that case the instrument error of the spatial orientation of discharge key seats increases the index of the necessary pitch angle.

In productive strata layers with the internal friction angle $\rho$, for which the tangent of the angle of the slot surface deviation $\phi$ from the vertical calculated on the basis of the above-mentioned formula is approximately (with 15% allowance) equal to $tg(45-\rho/2)$, i.e.

$$tg(\phi)=tg(45-\rho/2)\pm0.15,$$

constructed key seats are vertical, arbitrarily oriented, and have the same depth as the screw-shaped part of the key seat, and with an opening (width of the key seat) of not less than ⅓d, where d—is the well diameter.

The screw pitch is to be selected to be equal to the productive strata power—in cases where the estimated pitch of the screw-shaped discharged slot will exceed the strata thickness; The above-mentioned new operations, their consequence and terms of fulfillment provide a positive effect—increasing of any exploitation or recharge well rate.

EXAMPLE

The described method has been implemented on wells of Yamburg gas condensate deposit in January–February 2004, city of Yamburg, Russia, and on wells of Yen-Yakhinsky oil & gas condensate deposit in July–August 2004 city of New Urengoy, Russia.

At the well No.30509 at Yamburg gas & oil condensate deposit, city of Yamburg, Russia, where during the exploitation of the БУ$_{8\text{-}1}$ strata, laying in the interval 3140 . . . 3148 m, laid by consolidated mainly by quartz sand-rocks on clay—carbonaceous cement, a drastic drop of the well rate during its long-term (more than 10 years) exploitation of up to 30,000 cubic meters of gas-condensate mixture per day was fixed. The examination of rock samples in uniaxial compression devices allowed the determination that the internal friction angle was within 43° . . . 47°. Mine working dimensions were calculated: key seat opening (slot width) =0.13 . . . 0.18 m; depth L=0.6 . . . 1.0 m; the deviation angle of the slot surface relative to the vertical $\phi$=23° . . . 27°; and the turn angle $\alpha$=35° . . . 43°. Within 12 hours by means of a specially construction hydraulic abrasive system vertical mine works with following real dimensions were made: opening of the key seat (slot width)=0.2 m; depth L=2.0 m; the slot surface deviation angle from the $\phi$=25° . . . 28°; the turn angle $\alpha$=38° . . . 42°. So, the screw-shaped mine works made 2 turns for all thickness of the productive strata. As a result of works performed the well rate increased by 2.6 times and changed to 78,000 cubic meters of the gas condensate mixture per day.

The invention has been implemented—each mine work in the well area, made as vertical to the oriented one, had the screw-shaped form, in this juncture it always twice crossed at each screw turn the direction of force vectors of main massive stresses at a right angle. It provided the well rate increase.

The cited example of the method implementation is the best one, known by the applicant at the date of submission of the application, but not the only and limiting one.

The experiment confirmed the practicability of the offered method and the achievement of tasks-so, according to the offered method four productive strata were processed in different wells at depths of 3060–3870 meters with the average thickness of 8–10 meters. In all cases $tg(45-\rho/2)$ was 0.6–0.7. In each case the screw slot with the pitch of 1.2–1.3 meters for the whole thickness of the productive strata. The well rate initially was 30–60 cubic meters of gas per day. On all mentioned productive strata before the construction of discharge slots according to the offered technology intensification works were carried out by other known methods: acid treatments, hydraulic abrasive jetting and others. At the same time none of mentioned known methods of intensification provided the essential increase of well rate. After wells have been processed according to the method of the present invention, the capacity increased up to 120–160 thousand cubic meters per day.

So, the offered method is a new one and can be performed by well known technical facilities. It provides the achievement of the given task—increasing the capacity of any oil, gas, gas condensate, hydrogeologic, exploitation or recharge by the simplest and most efficient way.

What is claimed is:

1. A method of increasing a rate of an exploitation or a recharge well, the method comprising:

defining low production intervals in a productive strata; and decreasing the stress state in the well area by constructing slot-like discharge key seats around the well in the low production intervals, the slot-like discharge key seats being oriented away from the well into the low production intervals and forming screw-like shape in the well.

2. The method of claim 1, further comprising preliminary determining internal rock friction angles $\rho$ for a rock composing the productive strata; and selecting a pitch of the screw-like shape such that the tangent of an angle of deviation $\phi$ of the slot surface from a $\phi$ vertical is between $tg(45-\rho/2) \geqq tg(\phi) \geqq 1/\sqrt{3}$.

3. The method of claim 2, wherein if the pitch of the screw-like shape is more than a strata thickness, then the pitch is selected to be equal to the strata thickness.

4. The method of claim 1, further comprising making the screw like shave of the well with the slot-like discharge key seats made by separate vertical jogs by stages from the downside up by;

constructing two first vertical jogs parallel to a well axis, which two first vertical jogs being arbitrarily oriented relative to a direction of the main massive stress, having a height of 1 to 2 well diameters from a lower boundary of the productive strata, and being located symmetrically to the opposite directions from the well axis;

constructing a second pair of vertical jogs and at the same time turning a horizontal axis of symmetry of the second pair of jogs to the right relative to a horizontal symmetry axis of the first pair of axes by angle $\alpha$, calculated according to a formula: $\frac{1}{2} < (\sin\alpha = d/L) < \sqrt{2}/2$, wherein the second pair of vertical jogs is located above the first vertical jogs in such a way that a straight line, defined as connecting a top far point of any jog of the first pair of jogs with a point at the well axis disposed in one horizontal plane with the top far point, is disposed in the same horizontal plane with the far point of the base of the upper jog of the first pair of jogs and has an angle of deviation $\phi=(45-\rho/2)$ from the vertical, where $\rho$ is an internal friction angle; and constructing a third and following pairs of jogs of the same length, which pairs of jogs are orientated relative to the secod pair of jogs similarly to the orientation of the second pair of jogs relative to the first pair of jogs.

* * * * *